US007121785B2

(12) United States Patent
Carlson, Jr.

(10) Patent No.: US 7,121,785 B2
(45) Date of Patent: Oct. 17, 2006

(54) RETRACTION RETAINER SYSTEM FOR BIASED TURBINE ENGINE COMPONENTS

(75) Inventor: Charles A. Carlson, Jr., Chuluota, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 120 days.

(21) Appl. No.: 10/884,439

(22) Filed: Jul. 2, 2004

(65) Prior Publication Data

US 2006/0002787 A1 Jan. 5, 2006

(51) Int. Cl.
*F01D 21/12* (2006.01)
*F16J 15/02* (2006.01)

(52) U.S. Cl. ..... 415/9; 415/47; 277/917; 277/933

(58) Field of Classification Search ..... 415/9, 415/47; 277/917, 931, 933
See application file for complete search history.

(56) References Cited

U.S. PATENT DOCUMENTS

| | | | | |
|---|---|---|---|---|
| 2,908,309 | A | 10/1959 | Brill | |
| 3,030,997 | A | 4/1962 | Collins | |
| 4,105,040 | A * | 8/1978 | Chester | 277/933 |
| 4,600,344 | A | 7/1986 | Sutenbach et al. | |
| 4,828,444 | A | 5/1989 | Oshida | |
| 4,934,889 | A | 6/1990 | Kurosaki | |
| 5,098,242 | A | 3/1992 | Schaty | |
| 5,119,555 | A | 6/1992 | Johnson | |
| 5,120,175 | A | 6/1992 | Arbegast et al. | |
| 5,312,152 | A | 5/1994 | Woebkenberg, Jr. | |
| 5,326,208 | A | 7/1994 | Werner | |
| 5,380,221 | A | 1/1995 | Grabbe | |
| 5,909,990 | A | 6/1999 | Gombos | |
| 6,080,161 | A | 6/2000 | Eaves, III et al. | |
| 6,439,540 | B1 * | 8/2002 | Tse | 251/127 |
| 2003/0170092 | A1 | 9/2003 | Chiodo et al. | |

* cited by examiner

*Primary Examiner*—Richard A. Edgar

(57) ABSTRACT

A device, system, and method for securing a turbine engine seal in a retracted position enabling maintenance, assembly and disassembly of the turbine engine. The system can include a retainer arranged to retain the seal in a retracted position and constructed to fail at an engine operating temperature. Failure of the retainer allows movement of the seal from the retracted position to an operational position.

10 Claims, 5 Drawing Sheets

RETRACTION RETAINER SYSTEM FOR BIASED TURBINE ENGINE COMPONENTS

FIELD OF THE INVENTION

This invention is directed generally to turbine engines, and more particularly to retraction retainers for turbine engine components.

BACKGROUND OF THE INVENTION

Typically, turbine engines separate combustion gases from cooling fluids throughout various sections of the engine, for example, by using spring biased seals. Although spring biased seals effectively prevent leakage of the gases, the seals create challenges during maintenance, assembly, and disassembly procedures, as the seals often must be retracted from their operating positions to permit assembly or disassembly of surrounding turbine engine components.

Retraction of the seals enables workers to access necessary engine areas. Once assembly is complete, the seals are released from their retracted positions so that the seals perform their intended sealing function. Nevertheless, it is not unusual for workers to forget to free the biased seals. In some turbine engines, the seals are not readily noticeable during a visual inspection or even during engine tests. Operating a turbine engine with a retracted seal can cause increased engine wear and decreased efficiency. In more serious circumstances, a retracted seal can cause catastrophic engine failure.

To date, personnel have been relied upon to remove retraction devices from spring biased seals at the appropriate time, subjecting proper engine operation to human error. Accordingly, a need exists for a retraction device that enables routine maintenance and assembly that does not require intervention by personnel to move the seal from a retracted position to an operational position.

SUMMARY OF THE INVENTION

The invention relates to a retraction device, system, and method for retaining a biased turbine engine component, such as a seal, in a retracted position during maintenance, assembly and disassembly procedures. Turbine engine seals, and other biased engine elements, are positioned against adjacent engine components and, therefore, must be retained in a retracted position during maintenance assembly and disassembly procedures. Aspects of the invention are described herein in the context of a biased seal for closing leaking paths between blade rings. However, principles of the invention can have application beyond this example.

According to aspects of the invention, a system for retaining a turbine engine seal can be used with a seal movable from an operational position to a retracted position. The seal can include a seal biasing member, such as a coil spring, for positioning the seal in the operational position. A retainer can be provided to secure the seal in the retracted position and the retainer is constructed to fail during engine operation and engine operating temperature or at a temperature greater than an ambient temperature of the engine at rest. Thus, even if the retainer is unintentionally left connected to the seal assembly, merely operating the engine will cause the retainer to fail and allow the seal to return to its operational position.

The retainer can fail in a variety of manners, such as by deformation, melting, burning, disintegration, combustion, phase transformation, or yielding, or a combination thereof.

For example, the retainer can be constructed of a material having a melting point which is less than or equal to an engine operating temperature during start up or at steady state. Once the engine temperature is greater than the material's melting point, the material melts, causing the retainer to fail and allow movement of the seal from the retracted position to its operational position.

In at least one embodiment, the seal can be a blade ring seal. The blade ring seal seats at least partially in a mating recess and extends out of the recess under the force of one or more springs to engage and seal against an adjacent blade ring assembly. The seal can include a post extending from the seal through an orifice in the recess and arranged for engagement with the retainer on an opposite side of the blade ring. In one example, the post can include a threaded portion, and the retainer can be a threaded nut. The nut can be rotated along the post, thereby drawing the seal into a retracted position within the recess. In another example, the post can include a head and the retainer can include a washer or a U-shaped wedge, that can be placed around the post and can abut against the head to prevent withdrawal of the post and a return of the seal to the operational position.

In operation, the turbine engine seal can be moved into a retracted position, and the retainer can be used to secure the seal in the retracted position to allow for maintenance, assembly, or disassembly procedures. Although the retainer can be removed after completion of the procedures, such removal is not necessary. Instead, standard operation of the engine causes the retainer to fail, which allows the seal to return to the operational position.

An advantage of this invention is that the even if a worker unintentionally leaves a turbine engine seal in a retracted position, operation of the engine can destroy the retainer and release the seal, allowing the engine to function as designed.

Another advantage of this invention is that use of such a retainer will prevent inefficient engine operation due to retracted seals.

Yet another advantage of this invention is the elimination of engine down time due to seals remaining in a retracted position.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose principles of the invention.

DETAILED DESCRIPTION OF THE INVENTION

The invention is directed to a system for retaining a biased turbine engine seal or other component in a retracted position during assembly and disassembly procedures. Although principles of the invention can have other applications, this description is directed to a blade ring seal. The system 10 is configured to hold a seal 26, in a retracted position, permitting maintenance, installation, or removal of various components of the turbine engine.

Figure 1:
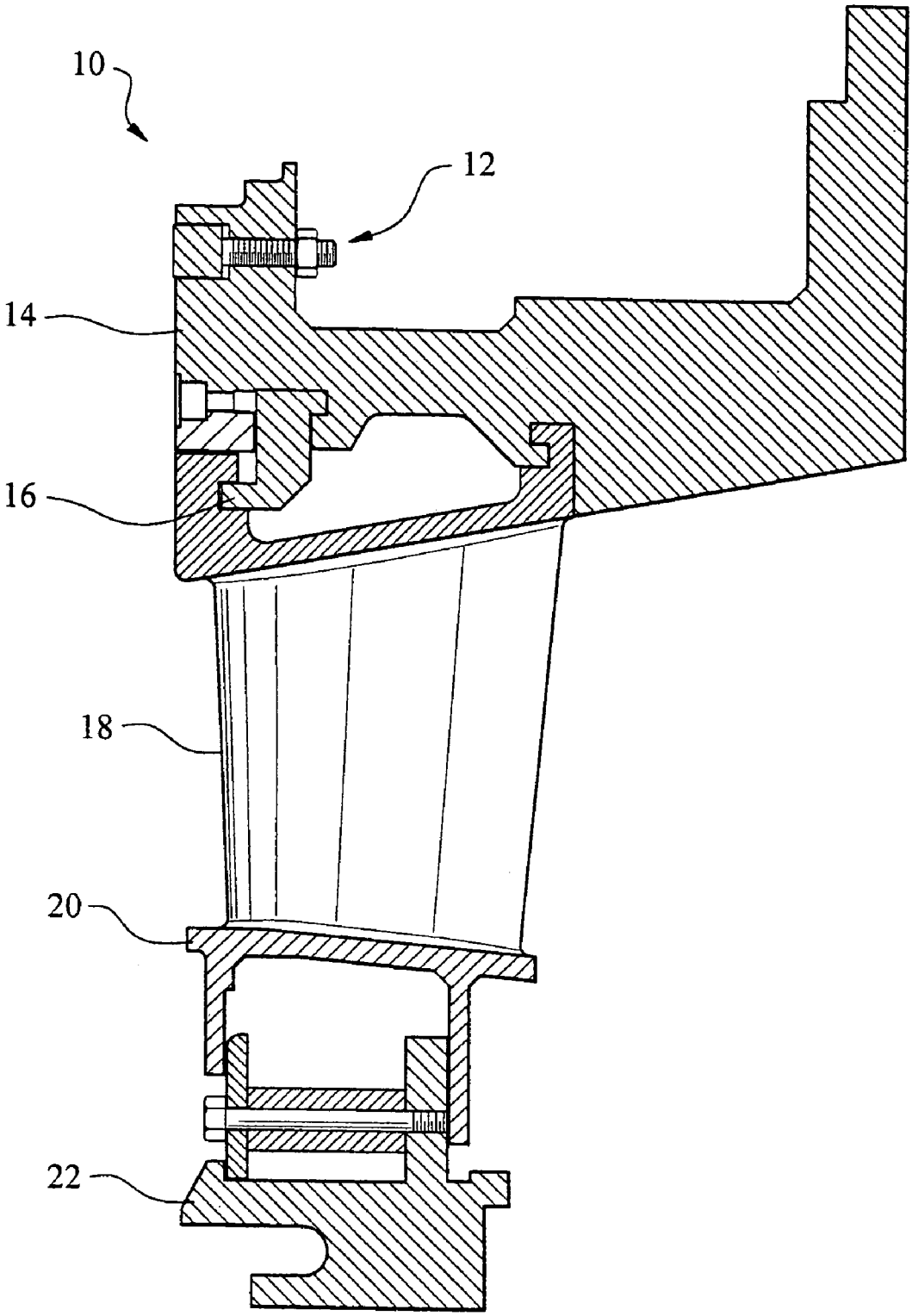
FIG. 1 is a side view of an exemplary turbine engine vane assembly having features according to the instant invention.

FIG. 1 illustrates a portion of an exemplary turbine engine vane assembly in which the system 10 may be used. As shown, the turbine engine can include multiple standard components such as a blade ring 14, an isolation ring 16, a turbine vane segment 18, a vane inner shroud 20, and an interstage seal housing 22. These components are shown by way of example, not limitation. Although the system 10 is shown mounted in a blade ring 14, the system 10 may be used in other sections of a turbine engine. Further, the system 10 can be used in other various engine designs and with other biased elements that require retention in a retracted position for maintenance, assembly, or disassembly procedures.

Figure 2:
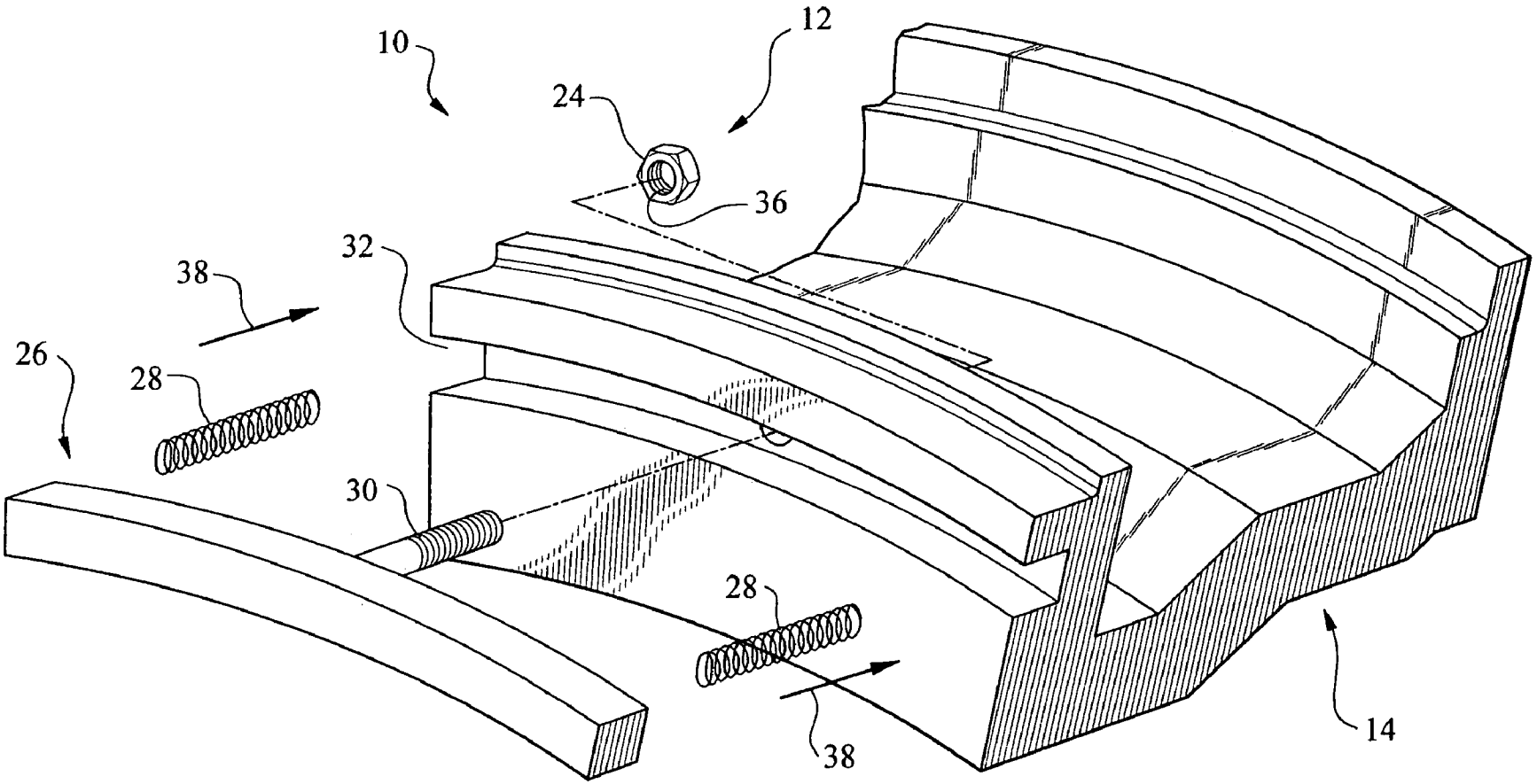
FIG. 2 is a perspective view of a blade ring portion of the turbine engine vane assembly shown in FIG. 1.
Figure 3:
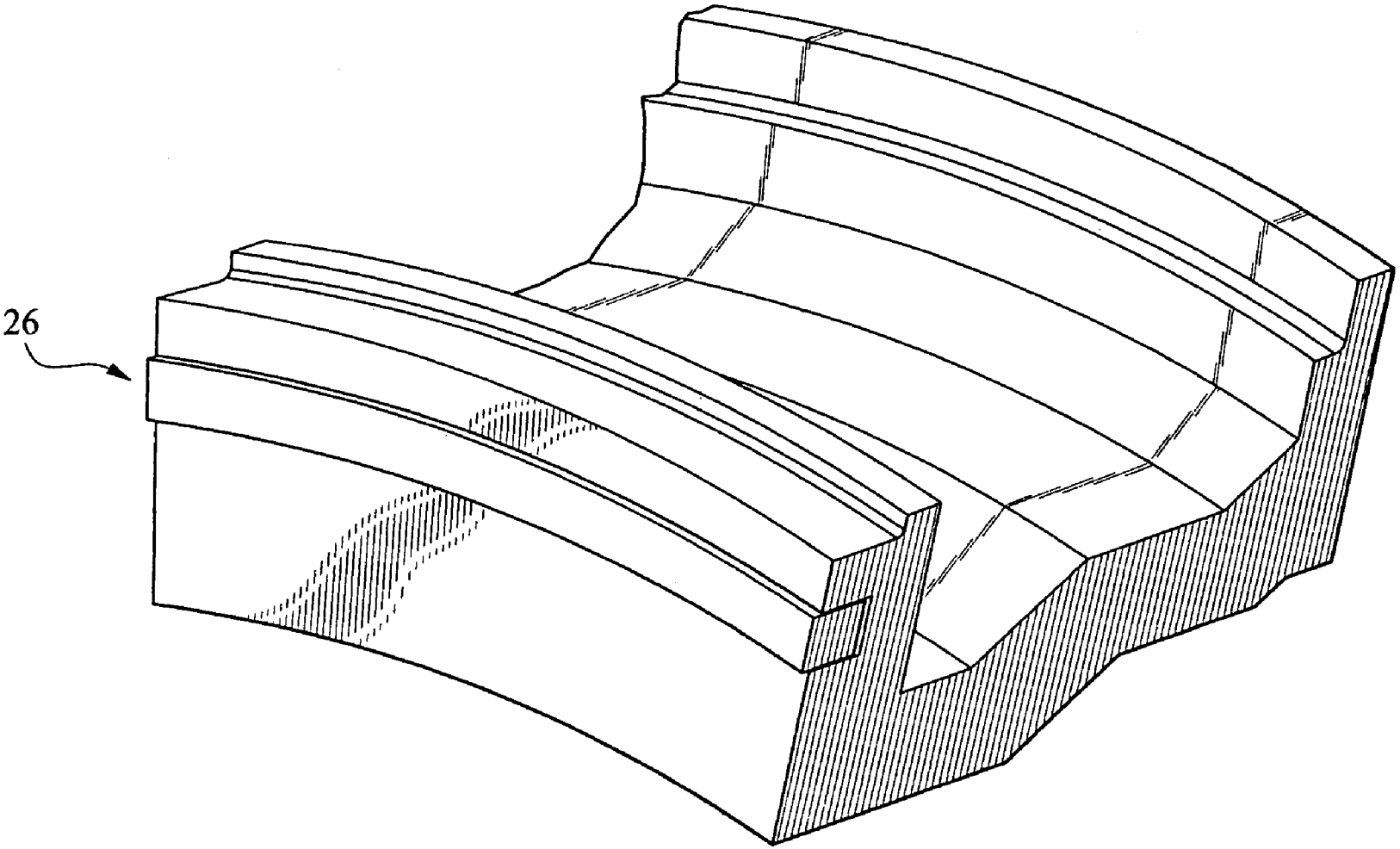
FIG. 3 is another perspective view of the blade ring portion of FIG. 2 with the seal in a retracted position.
Figure 4:
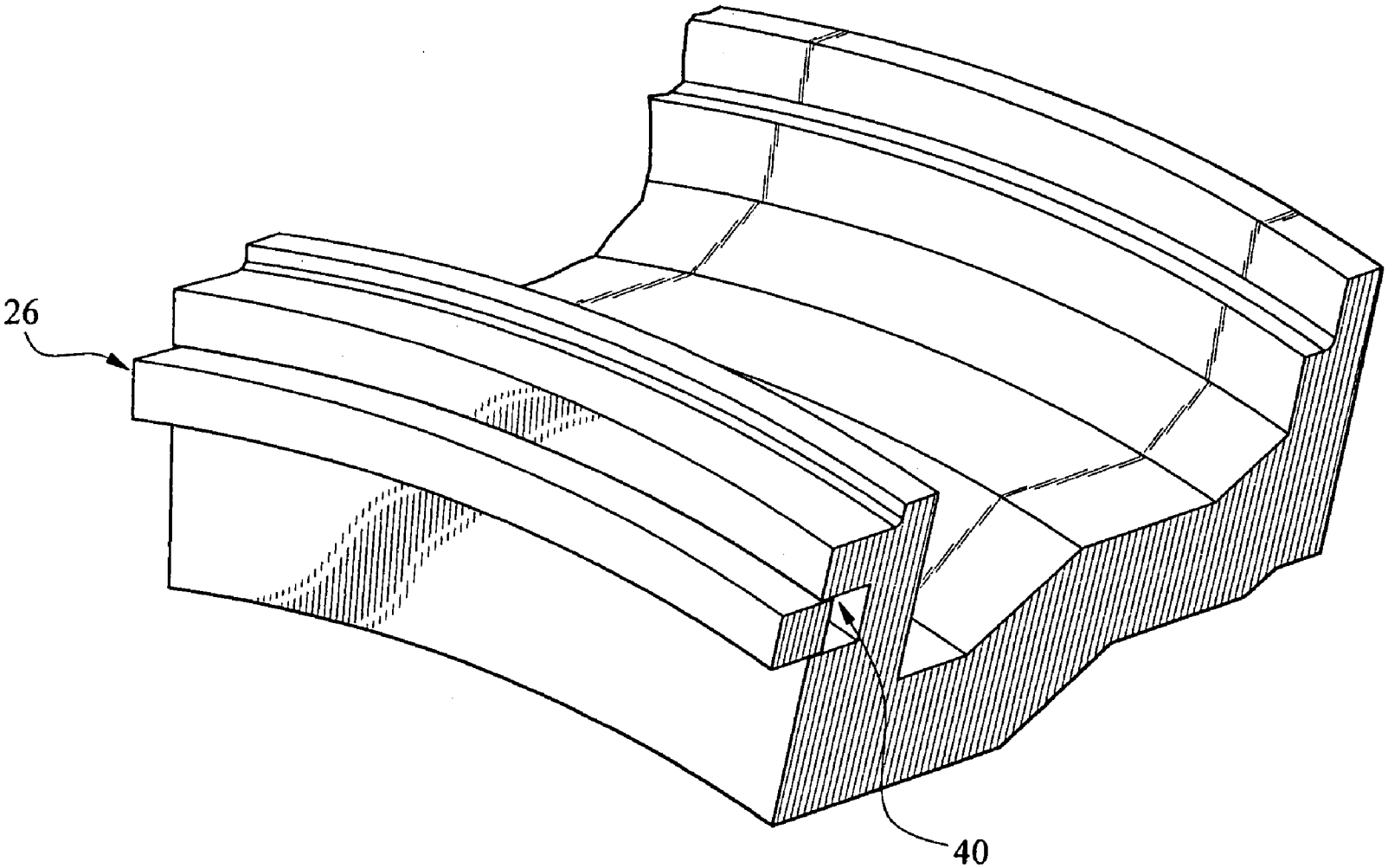
FIG. 4 is yet another perspective view of the blade ring portion of FIG. 2 with the seal in an operational position.

As shown in FIG. 2, the system 10 can include a biased turbine engine component, such as a blade ring face seal 26, a seal biasing member, such as coil springs 28, and a retainer, such as a nut 12. The blade ring seal 26 seats at least partially in a mating recess 32. The seal 26 is movable under force of the spring 28 to an operational position, shown in FIG. 4 in which a portion of the seal extends outside a gap 40 in a blade ring to engage and seal against an adjacent blade ring (not shown). The seal 26 can move to a retracted position, shown in FIG. 3, and the retainer is arranged to retain the seal 26 in the retracted position. The retainer may be arranged to retain the seal 26 or other biased components having any shape, size, or location.

The biasing member can be any suitable spring or other force exerting device, such as compression springs, leaf springs, and the like, that force the seal 26 against the adjacent component in the operational position. In other embodiments, biasing members and the seal can be integral, formed, for example, from a piece of bent metal, which can provide a suitable biasing force.

In at least one embodiment, as shown in FIG. 2, the seal 26 may include a post 30 arranged for engagement with the nut or other retainer. The post extends through the recess 32 to extend through an orifice to an opposite side of the blade ring. Accordingly, the nut may be attached to the post 30 and secure the post 30 and the associated seal 26 by blocking abutment against the blade ring wall. For instance, the post 30 can have a threaded portion and the nut 24 can provide an aperture having threads 36, to rotate onto the post 30 to retain the seal 26. In at least one embodiment, the inner surface of the nut 24 aperture need not be threaded, and other forms of secure engagement can be provided, such as friction fit and ratchets, to name just a few. Alternatively, the nut 24 can be constructed of a pliable material that can form threads as the nut 24 is rotated onto the threads of the post 30.

Figure 5:
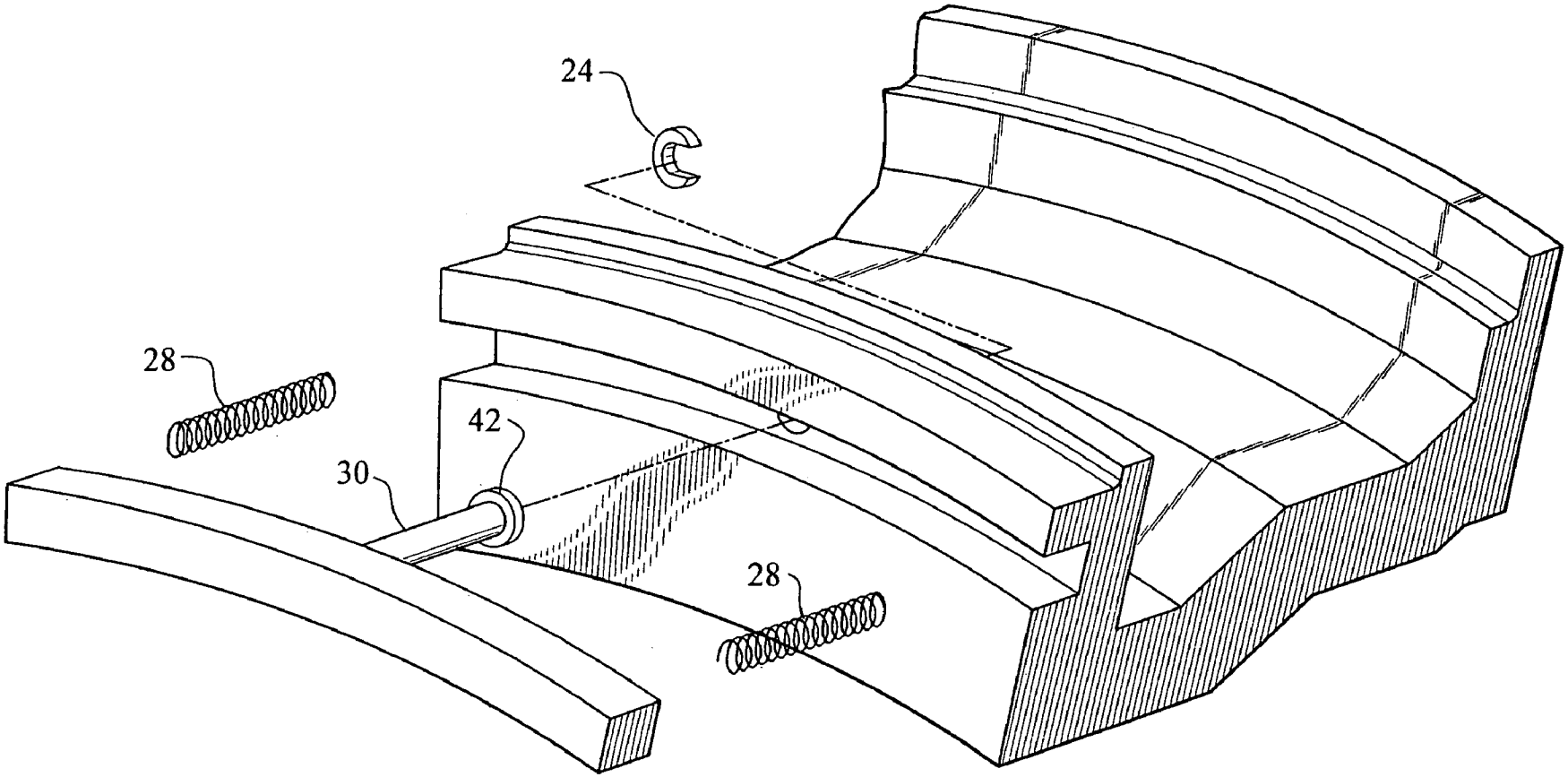
FIG. 5 is a perspective view of another embodiment of a retraction retainer for a blade ring portion of the turbine engine.

In another embodiment, shown in the FIG. 5, the retainer may be a U-shaped washer 24 or wedge that secures the seal 26 in a retracted position by blocking movement of the post 30. Although not necessary, the post 30 can include a lip or head 42 under which the U-shaped washer 24 can be placed for engaging the lip or head 42 and preventing movement of the post 30 under the force of the springs 28.

The retainer can be provided in other shapes, sizes and geometries. The retainer can include for example spacers, clips, blocks, braces and even adhesives to engage a post or other part of a seal.

The retainer is preferably designed to fail at an engine operating temperature occurring during engine start up. Alternatively, failure can occur at a temperature greater than an ambient temperature of an engine at rest and allow the seal 26 to move back to its operational position. Accordingly, failure can occur anytime during engine operation as the engine temperature rises from the engine temperature at commencement of engine operation to a maximum engine operating temperature. Failure results because the material, from which the retainer is constructed, undergoes one or more of deformation, melting, burning, disintegration, combustion, phase transformation, or yielding, or a combination thereof. Such failure of the retainer allows movement of the seal 26 from the retracted position to the operational position. Failure can be partial, such as melting of the threads of a nut, but preferably failure of the retainer is total, so that the entire retainer is eliminated.

The retainer can be constructed of a wax, plastic, metal, or any combination thereof, which will fail at engine operating temperature or at a temperature greater than an ambient temperature of an engine at rest. The materials forming the retainer can also be selected so as to not interfere with engine operation. The materials of retainer can be selected so that corrosive fumes are not created during failure. Additionally, it should be appreciated that the retainer can be made of multiple materials, such as a retainer with an exterior material of greater strength and an inner material of weaker strength, but that will fail at a lower temperature.

In one example, the retainer can be constructed of a material having a melting point that is lower than or equal to an engine operating temperature. Once the engine temperature is greater than the material's melting point, the retainer fails by melting, which enables the biased component to move from the retracted position and return to its operational position. For instance, in a turbine engine, operating temperatures can reach between approximately 1000° F. to 3000° F. The retainer can be constructed of wax that melts at 200° F. Failure of the retainer can occur during the first few seconds of operation or at other times.

In operation, a seal 26 can be moved into a retracted position, as shown with the arrows 38 in FIG. 2. Once in the retracted position, the retainer can be used to secure the seal. For instance, in the exemplary embodiment illustrated in FIG. 2, the nut 24, can be screwed onto the post 30, thereby placing the seal 26 in a retracted position. Although the retainer can be removed after completion of maintenance, assembly or disassembly procedures, such removal is not necessary. Instead, standard operation of the engine causes the nut to fail and preferably melt away. Failure of the nut causes the seal 26 to return to the operational position.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A retraction retention system for a biased turbine engine component, comprising:

a turbine engine component movable between an operational position and a retracted position;

a biasing member coupled to the turbine engine component, the biasing member urging the turbine engine component to the operational position;

a retainer arranged to retain the turbine engine component in the retracted position against the force of the biasing member, wherein the retainer is constructed to fail at an engine operating temperature and allow movement of the turbine engine component from the retracted position to the operational position; and wherein the turbine engine component is a seal and the seal further comprises a post extending from the seal for engaging the retainer.

2. The system of claim 1, wherein the retainer is a nut with a threaded aperture, and the post provides a corresponding threaded portion for secure engagement with the nut.

3. The system of claim 1, wherein the post includes a head and the retainer includes a washer arranged to engage the head to secure the seal in the retracted position.

4. The system of claim 1, wherein the retainer fails in a manner selected from a group consisting of deformation, melting, burning, disintegration, combustion, yielding, and phase transformation.

5. The system of claim 4, wherein the retainer is constructed of a material having a melting point less than an engine operating temperature.

6. A retraction retention system for a biased turbine engine component, comprising:

a blade ring having a mating recess;

a face seal slidably attached to the blade ring, seated in the mating recess, and movable between an operational position in which the face seal extends outside of the mating recess and a retracted position in which at least a substantial portion of the face seal is positioned in the mating recess;

a spring coupled to the face seal, which biases the face seal towards the operational position;

a post extending from the face seal through an orifice in the blade ring; and a retainer attached to the post to retain the face seal in the retracted position against the force of the spring, wherein the retainer fails at an engine operating temperature and allows movement of the face seal from the retracted position to the operational position.

7. The system of claim 6, wherein the retainer is a nut with a threaded aperture, and the post provides a corresponding threaded portion for secure engagement with the nut.

8. The system of claim 6, wherein the post includes a head and the retainer includes a washer arranged to engage the head to secure the face seal in the retracted position.

9. The system of claim 6, wherein the retainer fails in a manner selected from a group consisting of deformation, melting, burning, disintegration, combustion, yielding, and phase transformation.

10. The system of claim 9, wherein the retainer is constructed of a material having a melting point less than an engine operating temperature.

* * * * *